US009675150B2

(12) United States Patent
Kim

(10) Patent No.: US 9,675,150 B2
(45) Date of Patent: Jun. 13, 2017

(54) PORTABLE ELECTRONIC DEVICE CASE HAVING CARD STORAGE COMPARTMENT

(71) Applicant: SPIGEN KOREA CO., LTD., Seoul (KR)

(72) Inventor: Dae-Young Kim, Seoul (KR)

(73) Assignee: SPIGEN KOREA CO., LTD., Geumcheon-Gu, Seoul (KR)

( * ) Notice: Subject to any disclaimer, the term of this patent is extended or adjusted under 35 U.S.C. 154(b) by 0 days.

(21) Appl. No.: 15/197,703

(22) Filed: Jun. 29, 2016

(65) Prior Publication Data

US 2016/0374443 A1 Dec. 29, 2016

Related U.S. Application Data

(60) Provisional application No. 62/186,004, filed on Jun. 29, 2015.

(51) Int. Cl.

| | |
|---|---|
| ***A45F 5/00*** | (2006.01) |
| ***A45C 11/18*** | (2006.01) |
| *A45C 11/00* | (2006.01) |

(52) U.S. Cl.

CPC ..... *A45C 11/182* (2013.01); *A45F 5/00* (2013.01); *A45C 2011/002* (2013.01); *A45C 2011/003* (2013.01)

(58) Field of Classification Search

CPC ..... A45C 2013/025; G06F 1/1628; H04B 1/3888; H04M 1/21; A45F 5/00

USPC ..... 206/320, 37

See application file for complete search history.

(56) References Cited

U.S. PATENT DOCUMENTS

| | | | | |
|---|---|---|---|---|
| 9,049,283 | B1 * | 6/2015 | Kim | H04M 1/21 |
| 2004/0173482 | A1 * | 9/2004 | Nieves | A45C 11/00 206/320 |
| 2007/0057004 | A1 * | 3/2007 | Butler | A45C 11/182 224/669 |
| 2014/0299488 | A1 * | 10/2014 | Andrew | A45C 13/002 206/37 |
| 2015/0141082 | A1 * | 5/2015 | Ehrlich | H04B 1/3888 455/575.1 |

OTHER PUBLICATIONS

"CandyShell Card iPhone SE, iPhone 5S & iPhone 5 Cases", http://www.speckproducts.com/apple/iphone-cases/iphone-5s-cases/candyshell-card-iphone-5s-cases/IP5-CS-CARD.html, Downloaded Dec. 15, 2016, 6 pages.

* cited by examiner

*Primary Examiner* — King M Chu
(74) *Attorney, Agent, or Firm* — East West Law Group; Heedong Chae

(57) ABSTRACT

A case for a portable electronic device includes a card storage compartment for storing one or more cards, a cover for covering the card storage compartment, and a first card retaining means. The card storage compartment has a bottom surface and a side wall of first, second and third walls and the first card retaining means is formed on the first wall for retaining the one or more cards in the card storage compartment by exerting pressure on the one or more cards. There may be second and third card retaining means, and the third card retaining means helps retaining the one or more cards by exerting pressure on the card(s) against the cover.

20 Claims, 14 Drawing Sheets

PORTABLE ELECTRONIC DEVICE CASE HAVING CARD STORAGE COMPARTMENT

CROSS-REFERENCE TO RELATED APPLICATIONS

This application claims priority to U.S. provisional patent application No. 62/186,004 filed Jun. 29, 2015, which is incorporated herein by reference.

FIELD OF THE INVENTION

The present invention relates to a case having a storage compartment for an electronic device and, more particularly, to a case, having a card storage compartment, for a portable electronic device such as a mobile phone, smart phone, tablet computer, and so forth. The card storage compartment can store a credit card, debit card, driver license, identification card, or the likes.

BACKGROUND OF THE INVENTION

Portable electronic devices, such as mobile phones, smart phones, tablet computers, and the like, have become popular and widely used for communication, entertainment, and other purposes. These electronic devices are intended to be carried or moved about, and as such, these devices are more likely to be accidentally dropped, hit, or scratched. To protect the portable electronic devices, protective cases were introduced and have become popular in connection with electronic devices such, as cell phones, smart phones, tablet computers, and the like.

There has been a trend towards combining several functions into the protective cases—for example, a case having a pocket or purse integrated therein. Among the many types of cases, flip/folio-style cases have become popular as a way to have a storage space for credit/debit cards. A cover flips open and closed over an electronic device such as a mobile phone or smart phone. Such a cover usually has a securing mechanism such as a snap, magnet, or hook and loop fasteners. Credit cards are usually stored inside the front cover of the case. In order to use the electronic device, the cover must be opened, thereby exposing the front of the device and the credit cards together. Thus, whenever a user uses the electronic device, the credit cards are exposed as well.

Furthermore, the sizes and shapes of modern cell phones are much more compact than in the past, and accordingly, the cases have become compact as well. However, adding a storage space for personal items, such as a credit card, tends to make the cases unnecessarily bulkier and heavier.

Therefore, to solve the above problems and facilitate the convenient carrying of personal items, such as credit/debit cards, there is a need for a case for an electronic device having a compact, stylish, and integrated structure with a card storage compartment. This invention is directed to solve these problems and satisfy the long-felt need.

SUMMARY OF THE INVENTION

The present invention contrives to solve the disadvantages of the prior art. The present invention provides a case having a storage compartment for an electronic device and, more particularly, to a mobile phone case having a card storage compartment, a cover, and a card retaining means. The card retaining means is constructed to exert pressure on one or more cards stored in the card storage compartment.

The object of the invention is to provide a case for a portable electronic device, which comprises: a card storage compartment for storing one or more cards, having a bottom surface and a side wall wherein the side wall comprises a first wall, a second wall, and a third wall; a cover for covering the card storage compartment; and a first card retaining means formed on the first wall for retaining the one or more cards by exerting pressure on the one or more cards. The first and second walls face each other, being connected to the third wall. The case may further comprise a second card retaining means formed on the second wall and a third card retaining means formed on the bottom surface.

Another object of the invention is to provide a case for an electronic device, comprising: a soft protective case which comprises a back panel to cover a back portion of the electronic device and a side panel extending from a front surface of the back panel along edges of the back panel wherein the soft protective case significantly covers the back portion and a side portion of the electronic device; a card storage compartment, formed on a rear surface of the back panel, for storing one or more cards, wherein the card storage compartment comprises a bottom surface and a side wall wherein the side wall comprises a first wall, a second wall, and a third wall; a hard protective cover for covering the card storage compartment wherein the hard protective cover is configured to removably mount over the soft protective case; and a first card retaining means formed on the first wall for retaining the one or more cards by exerting pressure on the one or more cards. The first and second walls face each other, being connected to the third wall. The soft protective case is sufficiently flexible to accept insertion of the electronic device therein and sufficiently rigid to securely retain the inserted electronic device. In addition, the case may further comprise a second card retaining means formed on the second wall and a third card retaining means formed on the bottom surface.

The advantages of the present invention are: (1) the case having a card storage compartment well protects an item, such as a credit card, stored in the card storage compartment; (2) one or more cards can be securely held in place in the card storage compartment of the present invention by one or more card retaining means formed on the card storage compartment to exert pressure on the one or more cards; (3) the case of the present invention has a compact, stylish, and integrated structure; (4) the credit card is not easily visible to others; (5) it is easy and convenient to store one or more cards in the card storage compartment of the case; (6) the card storage compartment or the soft protective case having the card retaining means can be molded by a single molding such as an injection molding and thus, it is easy to manufacture the case and the manufacturing cost is low; and (7) the cover or the hard protective cover having the card retaining means can be molded by a single molding such as an injection molding and thus, it is easy to manufacture the case and the manufacturing cost is low.

Although the present invention is briefly summarized, a fuller understanding of the invention can be obtained by the following drawings, detailed descriptions, and appended claims.

BRIEF DESCRIPTION OF THE DRAWINGS

These and other features, aspects, and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
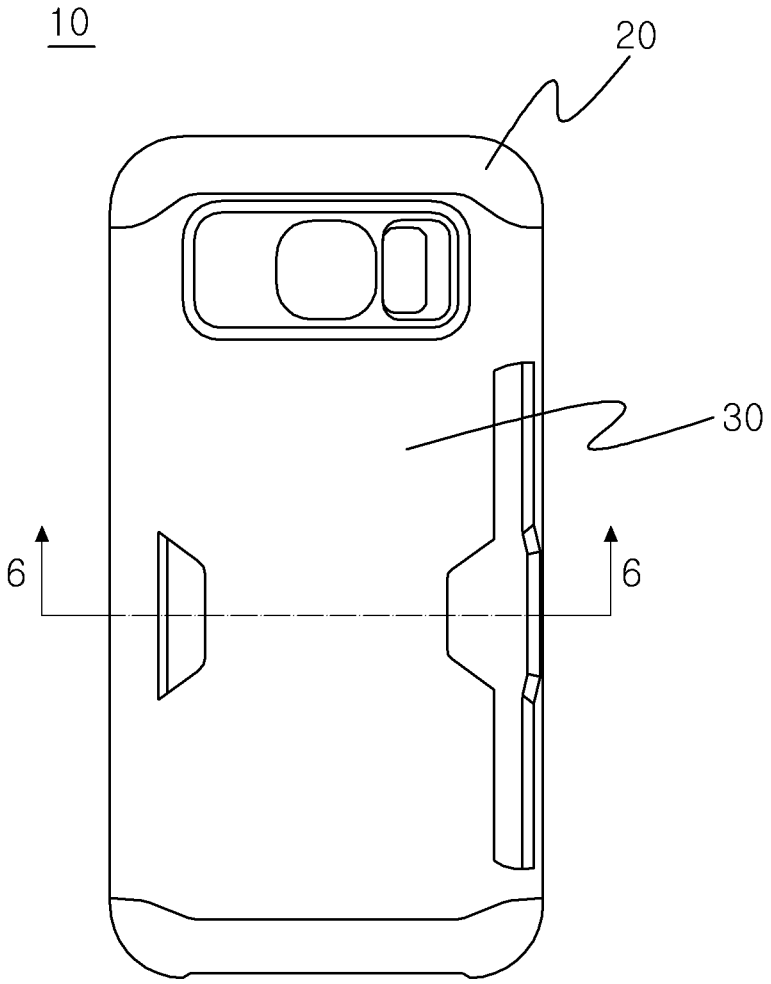
FIG. 1 shows a rear view of a case comprised of a soft protective case and a hard protective cover according to one embodiment of the present invention.
Figure 2:
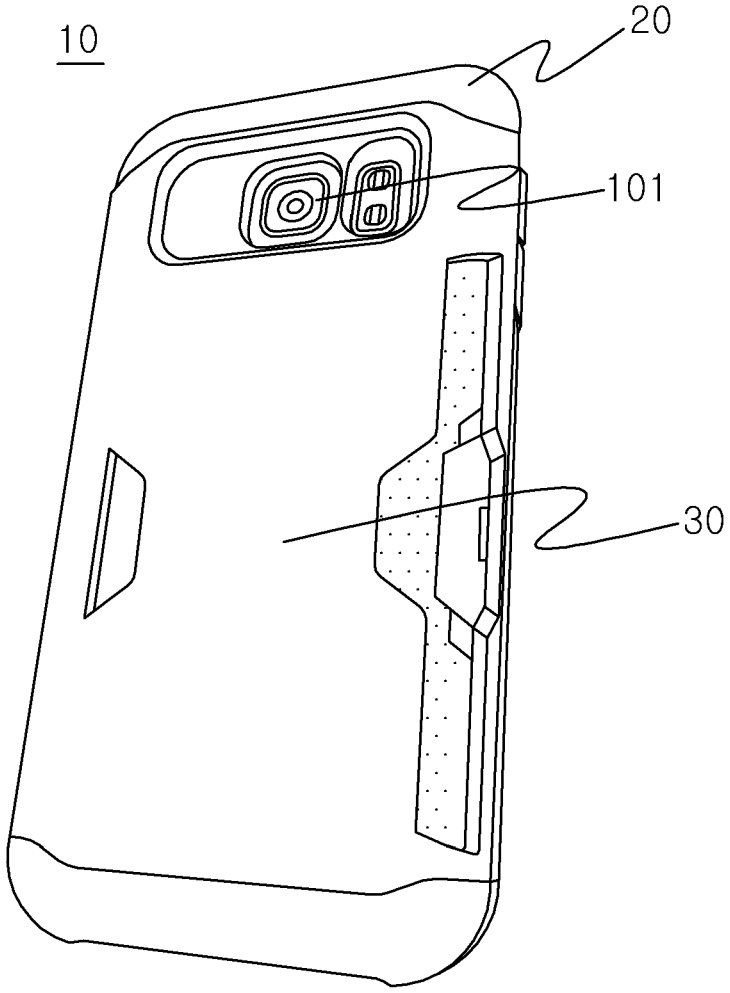
FIG. 2 shows a rear perspective view of the case according to the present invention.
Figure 3:
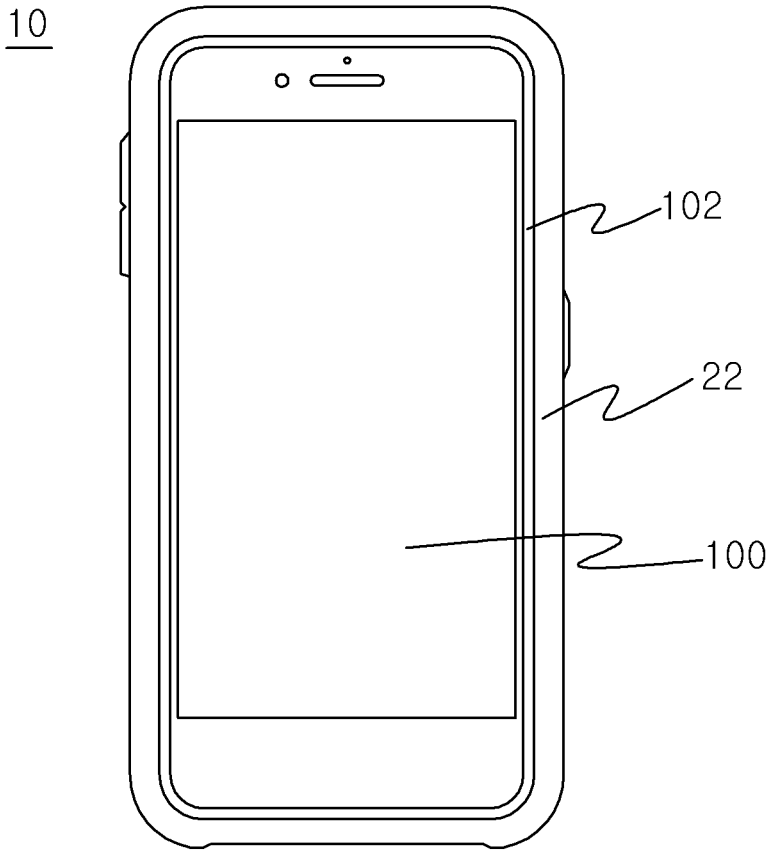
FIG. 3 shows a front view of the case of the present invention with a smart phone therein.
Figure 4:
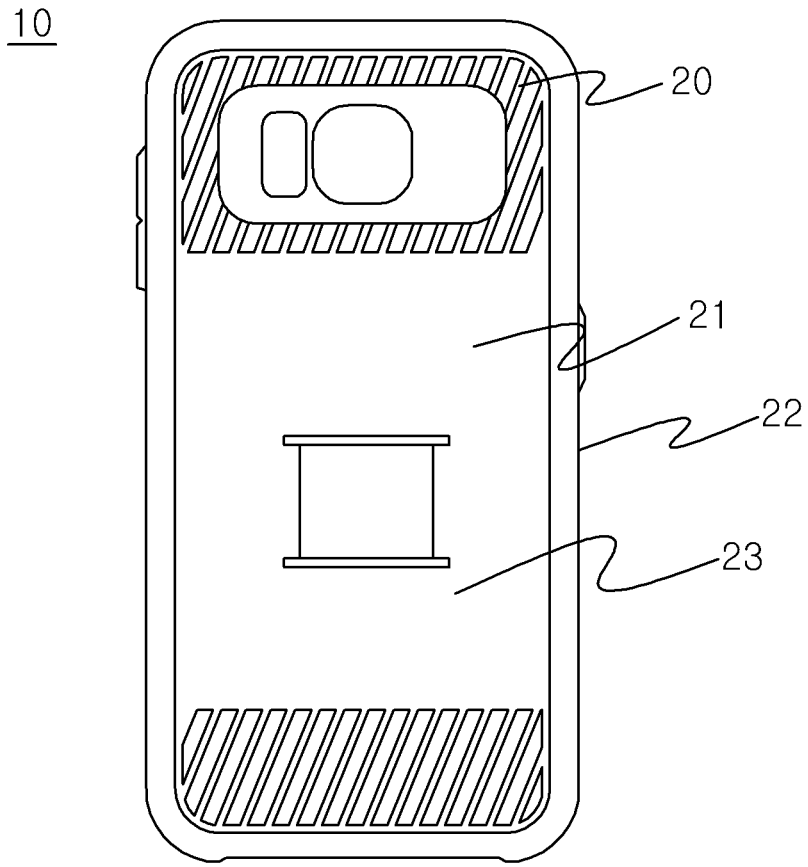
FIG. 4 shows another front view of the case of the present invention without a smart phone therein.
Figure 5:
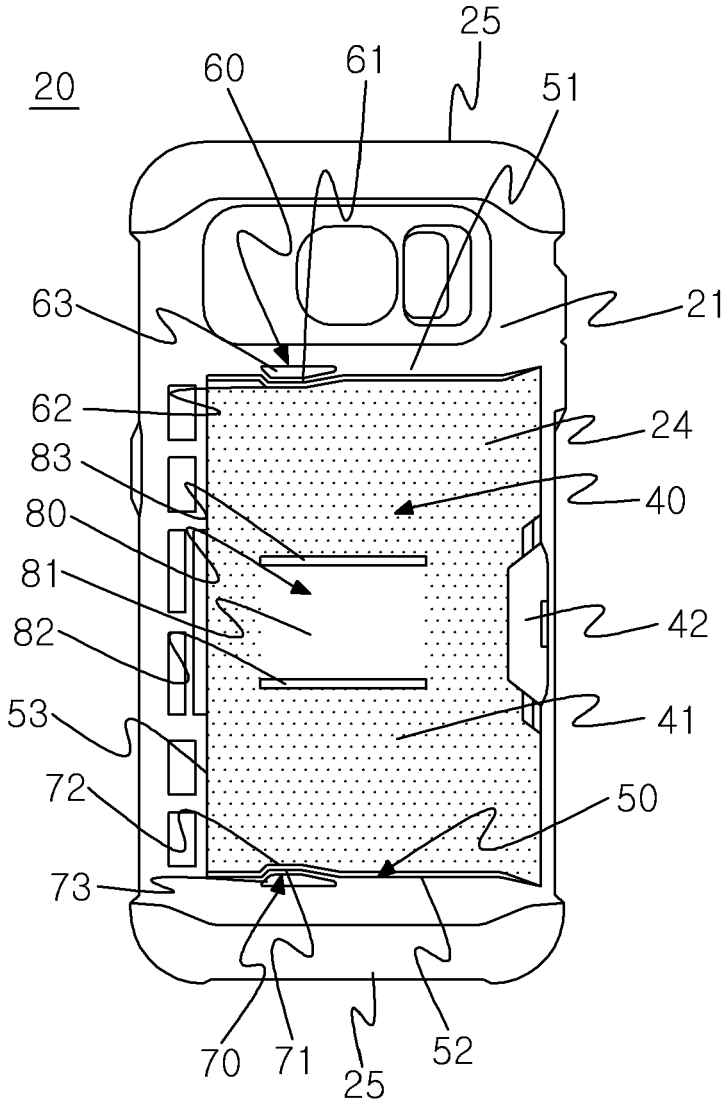
FIG. 5 shows a rear view of the soft protective case according to the present invention showing a card storage compartment.
Figure 7:
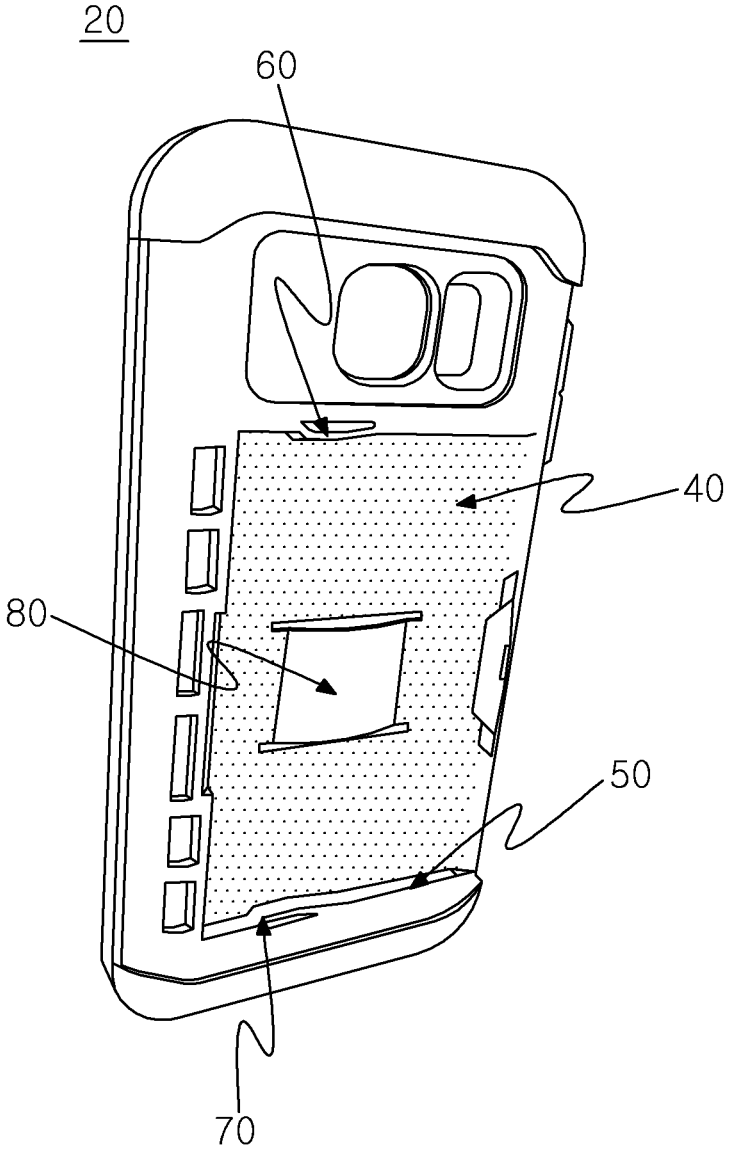
FIG. 7 shows a rear perspective view of the soft protective case of the present invention.
Figure 8:
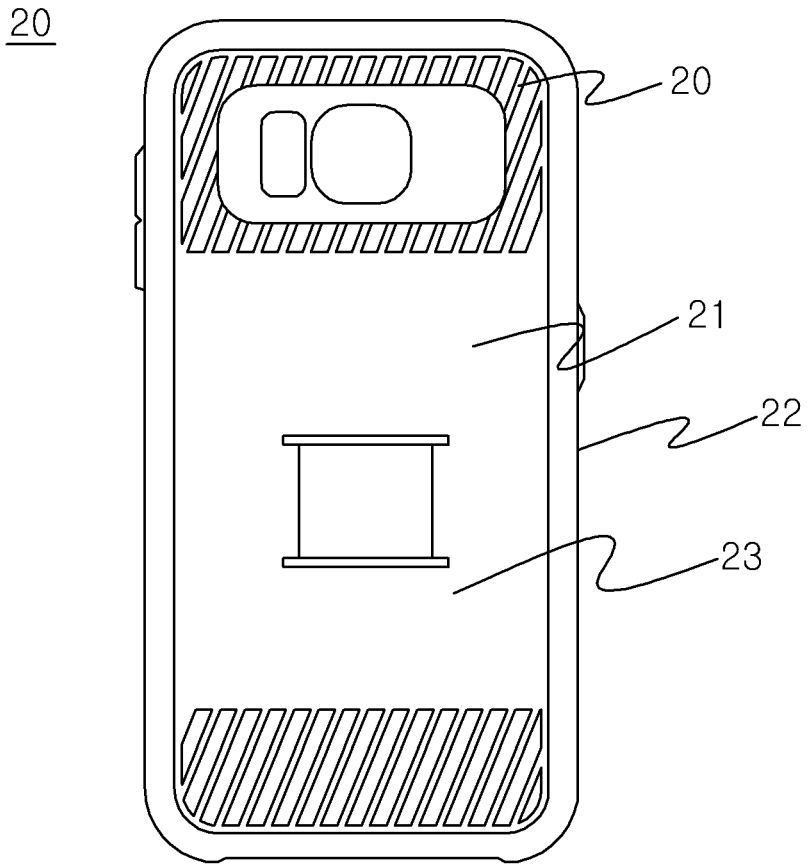
FIG. 8 shows a rear view of the soft protective case of the present invention.
Figure 9:
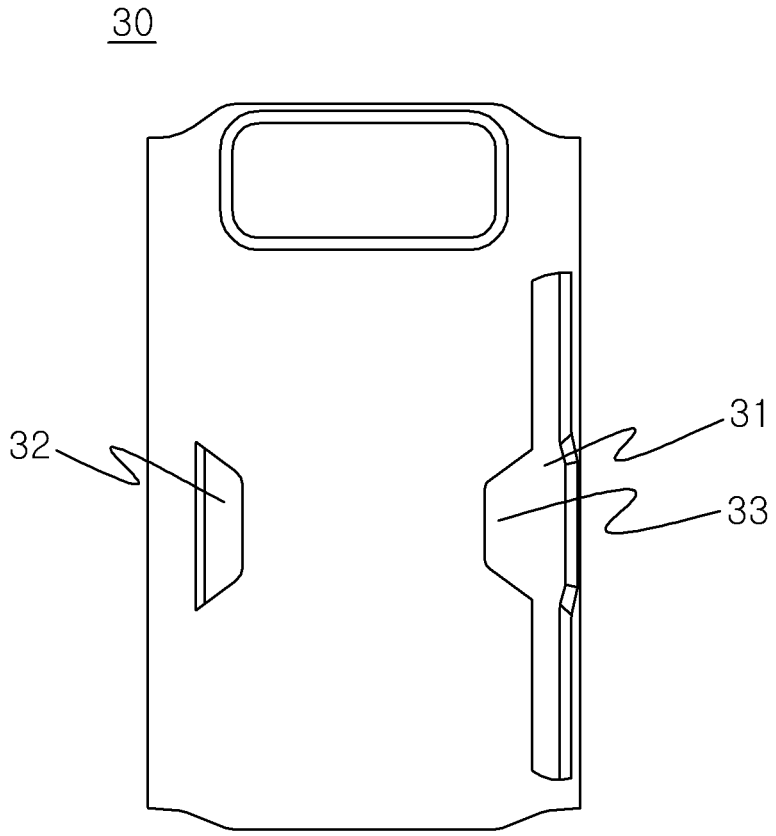
FIG. 9 shows a rear view of the hard protective cover of the present invention.
Figure 10:
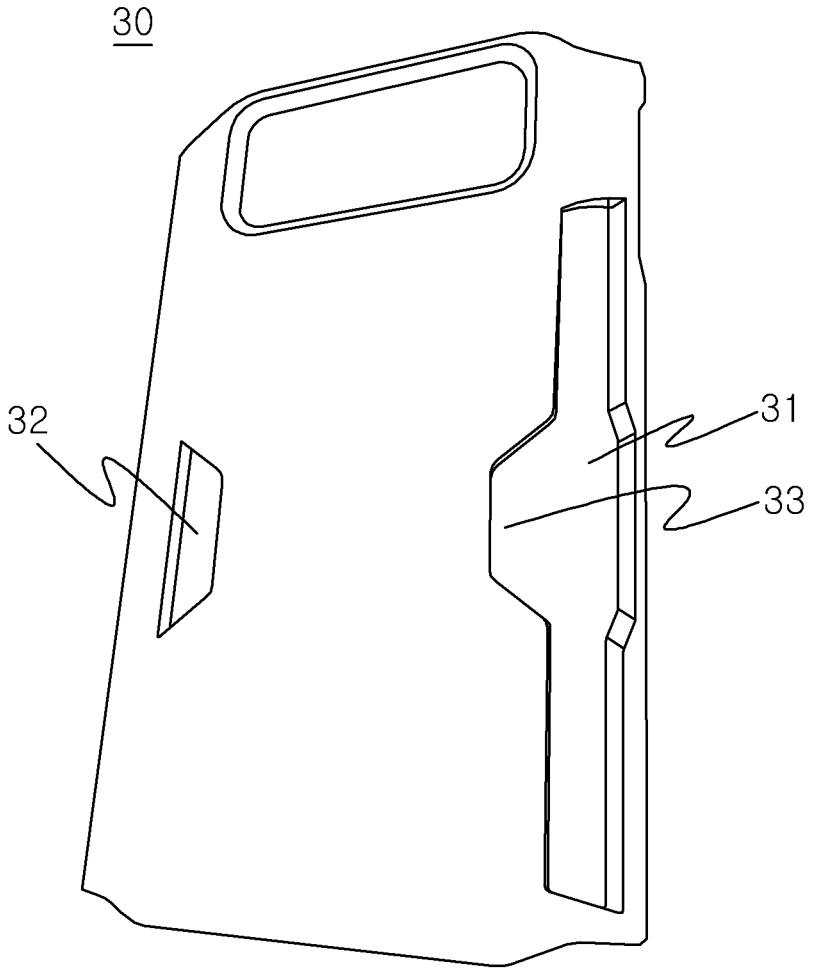
FIG. 10 shows a rear perspective view of the hard protective cover of the present invention.
Figure 11:
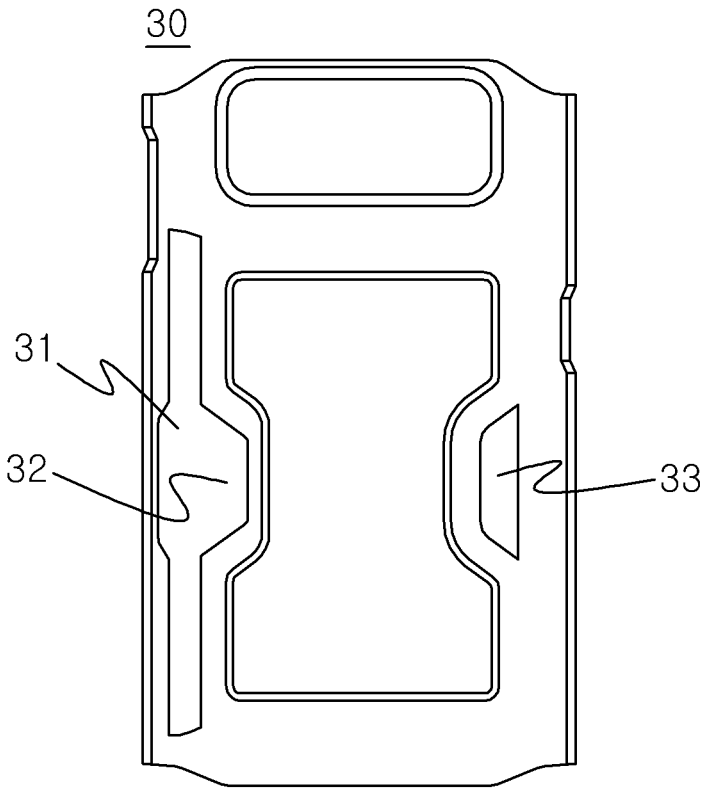
FIG. 11 shows a rear view of the hard protective cover of the present invention.

FIGS. 1-4 and 6 show various views of the case 10 comprised of a soft protective case 20 and a hard protective cover 30. FIGS. 5, 7 and 8 show various views of the soft protective case 20, and FIGS. 9 through 11 show various views of the hard protective cover 30.

The case 10 of the present invention for a portable electronic device 100 comprises: a card storage compartment 40 for storing one or more cards 90, having a bottom surface 41 and a side wall 50 wherein the side wall 50 comprises a first wall 51, a second wall 52, and a third wall 53; a cover 30 for covering the card storage compartment 40; and a first card retaining means 60 formed on the first wall 51 for retaining the one or more cards 90 in the card storage compartment 40 by exerting pressure on the one or more cards 90.

The first and second walls 51 and 52 face each other. In addition, the third wall 53 may be connected to both of the first and second walls 51 and 52, leaving one side without any wall open. Here, wall means a structure to define a boundary of a surface such as the bottom surface 41, and the wall's width is not necessarily shorter than its height as the first and second walls 51, 52 show.

The cards 90 to be stored in the card storage compartments 40 may be a debit/credit card(s), identification card, driver license, business cards, or the likes.

Figure 12:
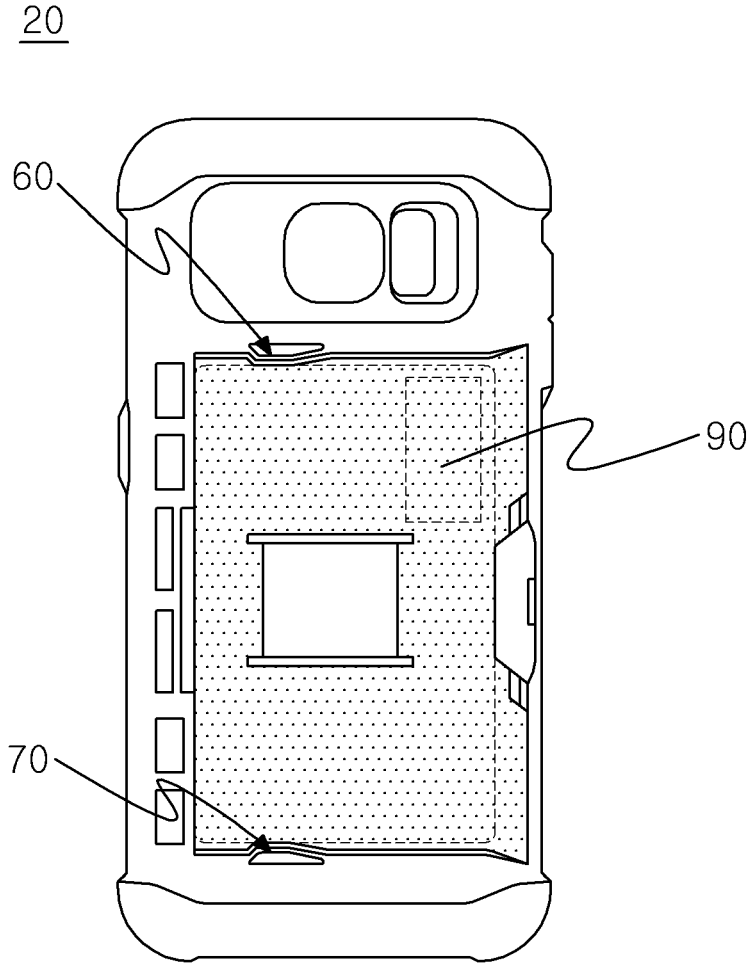
FIG. 12 shows a rear view of the soft protective case with a card stored in the card storage compartment.
Figure 13:
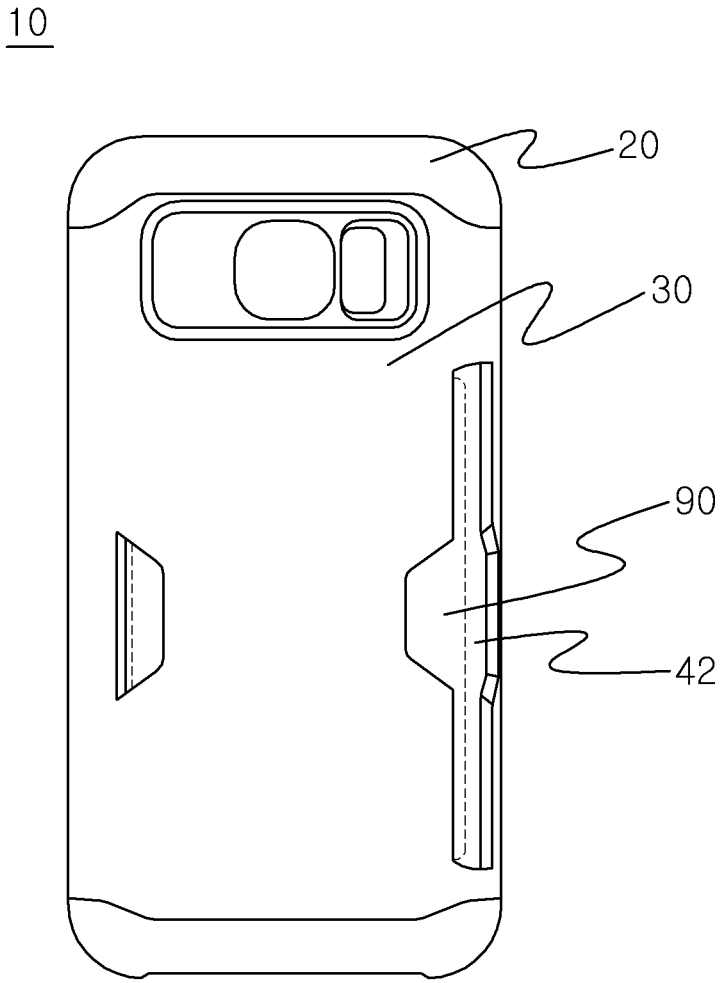
FIG. 13 shows a rear view of the case with a card stored in the card storage compartment.
Figure 14:
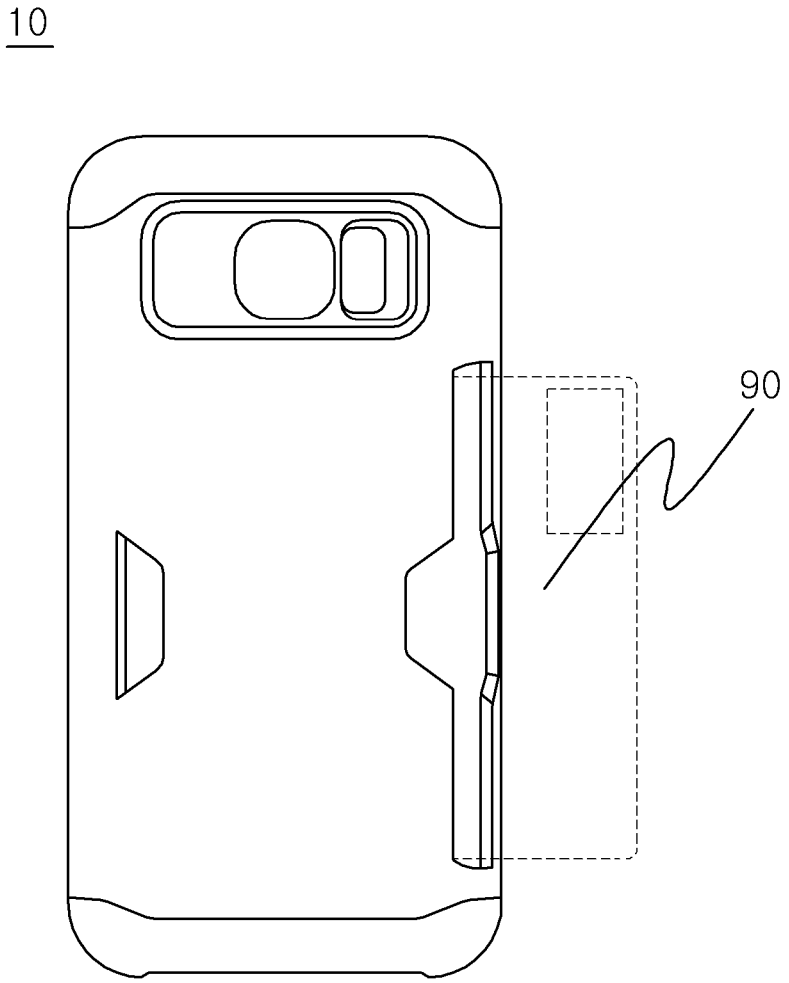
FIG. 14 shows a rear view of the case with a card being inserted into or removed from the card storage compartment

The first card retaining means 60 may be made of elastic material. The first card retaining means 60 comprises a first elastic protrusion 61 protruded from the first wall 51 towards the direction of the one or more cards 90 stored in the card storage compartment 40. In other words, the first elastic protrusion 61 is protruded from the first wall 51 toward the space for storing the one or more cards 90, or downwards, as shown in FIG. 5 or 12.

Furthermore, the first elastic protrusion 61 is preferably sloped from the first wall 51 toward the third wall 53 in the direction of the one or more cards 90 in the card storage compartment 40. In other words, as shown in FIGS. 5, 7 and 12, the first elastic protrusion 61 begins to downwardly protrude from right to left of the first wall 51. Because of this slope construction, it is easy to slide a card 90 into the card storage compartment 40 along the slope of the first elastic protrusion 61. Once the card is completely inserted into the card storage compartment 40, the first elastic protrusion 61 is deformed and exerts pressure on the card 90 to hold the card 90 in position so the card 90 does not slip out of the card storage compartment 40 because of increased friction between the card 90 and the first elastic protrusion 61.

Preferably, there are two openings 62, 63 formed for the first elastic protrusion 61. A first bottom opening 62 is formed on the bottom surface 41 along a boundary of the first elastic protrusion 61. In addition, a first wall opening 63 is formed on the first wall 51 along another boundary of the first elastic protrusion 61 as in FIG. 5. Because of these openings 62, 63, only the first elastic protrusion 61 is deformed by the card 90 to exert pressure on the card 90 without much deforming other parts such as the bottom surface 41 or the first wall 51. Furthermore, this structure is much easier to manufacture and the manufacturing costs can be reduced while achieving the functional benefits and advantages. In other words, the first elastic protrusion 61 is formed as part of the first wall 51 along with the first bottom opening 62 and the first wall opening 63, and these elements 51, 61, 62, 63 can be molded together by a single shot of molding.

The case 10 may further comprise a second card retaining means 70 formed on the second wall 52 for retaining the one or more cards 90 by exerting pressure on the one or more cards 90. As shown in FIG. 5, the second card retaining means 70 is symmetrical to the first card retaining means 60 with respect to the card storage compartment 40, and the above explanation for card retaining means 60 applies to the second card retaining means 70 as well.

The second card retaining means 70 may be made of elastic material, and preferably, the second card retaining means 70 comprises a second elastic protrusion 71 which protrudes from the second wall 52 toward the direction of the one or more cards 90 in the card storage compartment 40.

Just like the first elastic protrusion 61, the second elastic protrusion 71 is sipped from the second wall 52 toward the third wall 53 in the direction of the one or more cards 90.

Furthermore, a second bottom opening 72 is formed on the bottom, surface 41 along a boundary of the second elastic protrusion 71, and a second wall opening 73 is formed on the second wall 52 along another boundary of the second elastic protrusion 71 as in FIG. 5.

As shown in FIG. 12, while the card 90 slides into the card storage compartment 40, it pushes the first and second elastic protrusions 61, 71 respectively upward and downward. The first and second elastic protrusion 61 and 71 are deformed and exert pressure on the card 90 to hold the card 90 in position, and so, the card 90 does not slip out of the card storage compartment 40 because of increased friction between the card 90 and the first and second elastic protrusions 61, 71.

The case 10 may further comprise a third card retaining means 80 formed on the bottom surface 41 for retaining the one or more cards 90 by exerting pressure on the one or more cards 90 against the cover 30.

Figure 6:
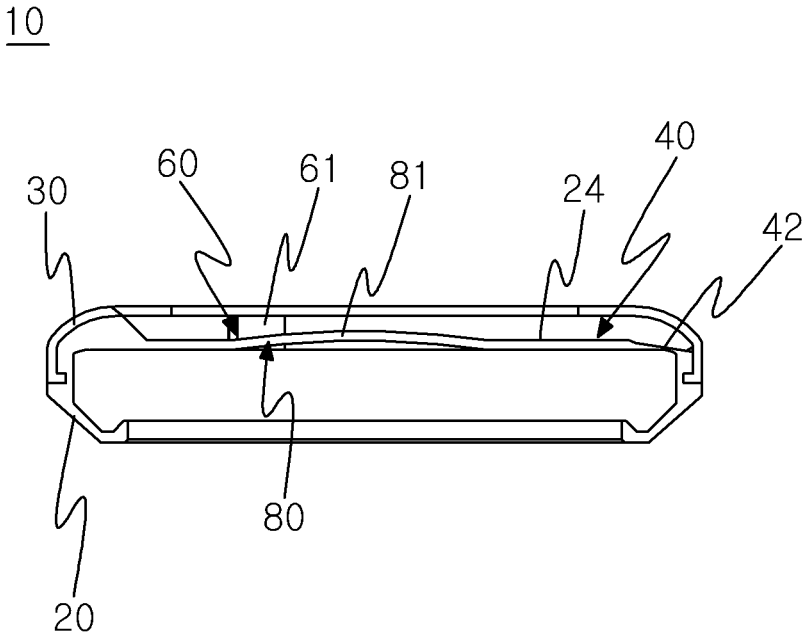
FIG. 6 shows a cross sectional view of the case.

As shown in FIGS. 5 and 6, the third card retaining means 80 may comprise a semi-elliptical, protrusion 81 made of elastic material and protruded from the bottom surface 41 toward a direction of the one or more cards 90 in the card storage compartment 40. The semi-elliptical shape of the semi-elliptical protrusion 81 is formed in the direction of the third wall 53. Here, "elliptical" includes "circular" which is one type of "elliptical".

Preferably, the semi-elliptical protrusion 81 has the dimension of 1.5 cm~2.5 cm width and 1.5 cm~2.5 cm length.

A pair of openings 82, 83 may be formed on the bottom surface 41 along both sides of the semi-elliptical protrusion 81 as in FIG. 5. Because of these openings 82 and 83, only the semi-elliptical protrusion 81 can be deformed to exert pressure on the card 90 without much deforming the bottom surface 41. Further, this construction is easy to manufacture, and the manufacturing cost can be reduced. Single mold can be made to manufacture the card storage compartment 40 along with the walls 51, 52, 53 and the first, second and third card retaining means 60, 70, 80, and thus, these elements 40, 51, 52, 53, 60, 70, 80 can be molded together by a single shot of molding.

A first cutout 31 may be formed on the cover 30 for inserting or removing the one or more cards 90 to or from the card storage compartment 40. A second cutout 32 may be formed on the cover 30 for pushing the one or more cards 90 for easy removal of the one or more cards 90 from the card storage compartment 40. The first and second cutouts 31, 32 are formed on opposite sides of the one or more cards 90 stored in the card storage compartment 40. Preferably, the bottom surface 41 is continuous to or flush with the first cutout 31 for easy insertion of the cards 90. In addition, there may be one or two bumps (not shown) on the bottom surface 41 near the first cutout 31.

Preferably, the card storage compartment 40 is made of soft material and the cover 30 is made of hard material. More preferably, the card storage compartment 40 may be made of thermoplastic polyurethane, and the cover 30 may be made of polycarbonate.

The whole card storage compartment 40 and the card retaining means 60, 70, and 80 may be made of same material preferably by a single molding.

In the alternative embodiment, a case 10 for an electronic device 100 includes: a soft protective case 20 which comprises a back panel 21 to cover the back portion 101 of the electronic device 100 and a side panel 22 extending from a front surface 23 of the back panel 21 along edges 25 of the back panel 21 to cover a side portion 102 of the electronic device 100 wherein the soft protective case 20 significantly covers the back portion 101 and the side portion 102 of the electronic device 100; a card storage compartment 40, formed on a rear surface 24 of the back panel 21, for storing one or more cards 90, wherein the card storage compartment 40 comprises a bottom surface 41 and a side wall 50 wherein the side wall 50 comprises a first wall 51, a second wall 52, and a third wall 53; a hard protective cover 30 for covering the card storage compartment 40 wherein the hard protective cover is constructed to removably mount over the soft protective case 20; and a first card retaining means 60 formed on the first wall 51 for retaining the one or more cards 90 by exerting pressure on the one or more cards 90.

The electronic device 100 usually has a screen on its front portion, and the other side of the front portion is the back portion 101.

The first and second walls 51 and 52 face each other, and preferably, the third wall 53 is connected to the first and second walls 51 and 52, leaving one side without any wall open.

The soft protective case 20 is sufficiently flexible to accept insertion of the electronic device 100 therein and sufficiently rigid to securely retain the inserted electronic device 100.

The first card retaining means 60 is preferably made of elastic material, and the first card retaining means 60 comprises a first elastic protrusion 61 protruded from the first wall 51 towards the direction of the one or more cards 90.

The first elastic protrusion 61 is sloped from the first wall 51 toward the third wall 53 in the direction of the one or more cards 90. A first bottom opening 62 is formed on the bottom surface 41 along a boundary of the first elastic protrusion 61, and a first wall opening 63 is formed on the first wall 51 along another boundary of the first elastic protrusion 61.

The case 10 may further comprise a second card retaining means 70 formed on the second wall 52 for retaining the one or more cards 90 by exerting pressure on the one or more cards 90.

The second card retaining means 70 is preferably made of elastic material, and the second card retaining means 70 comprises a second elastic protrusion 71 protruded from the second wall 52 towards the direction of the one or more cards 90.

The second elastic protrusion 71 is sloped from the second wall 52 toward the third wall 53 in the direction of the one or more cards 90. A second bottom opening 72 is formed on the bottom surface 41 along a boundary of the second elastic protrusion 71, and a second wall opening 73 is formed on the second wall 52 along another boundary of the second elastic protrusion 71.

The case 10 may further comprise a third card retaining means 80 formed on the bottom surface 41 for retaining the one or more cards 90 by exerting pressure on the one or more cards 90 against the hard protective cover 30.

The third card retaining means 80 comprises a semi-elliptical protrusion 81 made of elastic material and protruded from the bottom surface 41 towards the direction of the one or more cards 90, and a pair of openings 82 and 83 may be formed on the bottom surface 41 along both sides of the semi-elliptical protrusion 81.

A first cutout 31 is formed on the hard protective cover 30 for inserting or removing the one or more cards 90 to or from the card storage compartment 40, and a second cutout 32 is formed on the hard protective cover 30 for pushing the one or more cards 90 for easy removal of the one or more cards 90 from the card storage compartment 40.

Preferably, the soft protective case 20 and card storage compartment 40 are made of soft material, and the hard protective cover 30 is made of hard material. More preferably, the soft protective case 20 and card storage compartment 40 may be made of thermoplastic polyurethane, and the hard protective cover 30 may be made of polycarbonate.

As shown in FIG. 9, the first cutout 31 is longitudinal to allow easy passage of the one or more cards 90, and both ends of the first cutout 31 may taper towards the direction of the card storage compartment 40.

The first cutout 31 may further has an additional cutout 33 for easy access to the one or more cards 90 already retained in the card storage compartment 40.

Besides a depression 42 may be formed on the bottom surface 41 for easy handling of the one or more cards 90 already retained in the card storage compartment 40.

The soft protective case 20 may be made by a single molding and the hard protective cover 30 may be made by a single molding as well.

While the invention has been shown and described with reference to different embodiments thereof, it will be appreciated by those skilled in the art that variations in form, detail, compositions, and operation may be made without departing from the spirit and scope of the invention as defined by the accompanying claims.

What is claimed is:

1. A case (10) for a portable electronic device (100), comprising:

a card storage compartment (40) for storing one or more cards (90), having a bottom surface (41) and a side wall (50) wherein the side wall (50) comprises a first wall (51), a second wall (52), and a third wall (53);

a cover (30) for covering the card storage compartment (40); and a first card retaining means (60) formed on the first wall (51) for retaining the one or more cards (90) in the card storage compartment (40) by exerting pressure on the one or more cards (90), wherein the first and second walls (51), (52) face each other, wherein the first card retaining means (60) is made of elastic material, wherein the first card retaining means comprises a first elastic protrusion (61) protruded from the first wall (51) toward the direction of the one or more cards (90) in the card storage compartment (40), wherein a first wall opening (63) is formed on the first wall (51) along a boundary of the first elastic protrusion (61), wherein the cover (30) is constructed to removably mount over the card storage compartment (40).

2. The case (10) of claim 1, wherein the first elastic protrusion (61) is sloped from the first wall (51) toward the third wall (53) in the direction of the one or more cards (90).

3. The case (10) of claim 1, wherein a first bottom opening (62) is formed on the bottom surface (41) along a boundary of the first elastic protrusion (61).

4. A case (10) for a portable electronic device (100), comprising:

a card storage compartment (40) for storing one or more cards (90), having a bottom surface (41) and a side wall (50) wherein the side wall (50) comprises a first wall (51), a second wall (52), and a third wall (53);

a cover (30) for covering the card storage compartment (40); and a first card retaining means (60) formed on the first wall (51) for retaining the one or more cards (90) in the card storage compartment (40) by exerting pressure on the one or more cards (90), and a second card retaining means (70) formed on the second wall (52) for retaining the one or more cards (90) in the card storage compartment (40) by exerting pressure on the one or more cards (90), wherein the first and second walls (51), (52) face each other, wherein the cover (30) is constructed to removably mount over the card storage compartment (40).

5. The case (10) of claim 4; wherein the second card retaining means (70) is made of elastic material, wherein the second card retaining means (70) comprises a second elastic protrusion (71) protruded from the second wall (52) towards the direction of the one or more cards (90), wherein the second elastic protrusion (71) is sloped from the second wall (52) toward the third wall (53) in the direction of the one or more cards (90) in the card storage compartment (40), wherein a second bottom opening (72) is formed on the bottom surface (41) along a boundary of the second elastic protrusion (71), wherein a second wall opening (73) is formed on the second wall (52) along another boundary of the second elastic protrusion (71).

6. The case (10) of claim 4, further comprising a third card retaining means (80) formed on the bottom surface (41) for retaining the one or more cards (90) in the card storage compartment (40) by exerting pressure on the one or more cards (90) against the cover (30).

7. The case (10) of claim 6, wherein the third card retaining means (80) comprises a semi-elliptical protrusion (81) made of elastic material and protruded from the bottom surface (41) towards the direction of the one or more cards (90) in the card storage compartment (40).

8. The case (10) of claim 7, wherein a pair of openings (82), (83) are formed on the bottom surface (41) along both sides of the semi-elliptical protrusion (81).

9. A case (10) for a portable electronic device (100), comprising:

a card storage compartment (40) for storing one or more cards (90), having a bottom surface (41) and a side wall (50) wherein the side wall (50) comprises a first wall (51), a second wall (52), and a third wall (53);

a cover (30) for covering the card storage compartment (40); and a first card retaining means (60) formed on the first wall (51) for retaining the one or more cards (90) in the card storage compartment (40) by exerting pressure on the one or more cards (90), wherein the first and second walls (51), (52) face each other, wherein a first cutout (31) is formed on the cover (30) for inserting or removing the one or more cards (90) to or from the card storage compartment (40), wherein a second cutout (32) is formed on the cover (30) for pushing the one or more cards (90) in the card storage compartment (40) for easy removal of the one or more cards (90) from the card storage compartment (40), wherein the cover (30) is constructed to removably mount over the card storage compartment (40).

10. The case (10) of claim 9, wherein the card storage compartment (40) is made of thermoplastic polyurethane and the cover (30) is made of polycarbonate.

11. A case (10) for an electronic device (100), comprising:

an elastomeric protective case (20) which comprises a back panel (21) to cover a back portion (101) of the electronic device (100) and a side panel (22) extending from a front surface (23) of the back panel (21) along edges (25) of the back panel (21) to cover a side portion (102) of the electronic device (100) wherein the elastomeric protective case (20) significantly covers the back portion (101) and the side portion (102) of the electronic device (100);

a card storage compartment (40), formed on a rear surface (24) of the back panel (21), for storing one or more cards (90), wherein the card storage compartment (40) comprises a bottom surface (41) and a side wall (50) wherein the side wall (50) comprises a first wall (51), a second wall (52), and a third wall (53);

an inelastic protective cover (30) for covering the card storage compartment (40) wherein the inelastic protective cover (30) is constructed to removably mount over the elastomeric protective case (20); and a first card retaining means (60) formed on the first wall (51) for retaining the one or more cards (90) in the card storage compartment (40) by exerting pressure on the one or more cards (90), wherein the first and second walls (51), (52) face each other, wherein the elastomeric protective case (20) is sufficiently flexible to accept insertion of the electronic device (100) therein and sufficiently rigid to securely retain the inserted electronic device (100), wherein the first card retaining means (60) is made of elastic material, wherein the first card retaining means (60) comprises a first elastic protrusion (61) protruded from the first wall (51) towards the direction of the one or more cards (90) in the card storage compartment (40), wherein the first elastic protrusion (61) is sloped from the first wall (51) toward the third wall (53) in the direction of the one or more cards (90) in the card storage compartment (40), wherein a first bottom opening (62) is formed on the bottom surface (41) along a boundary of the first elastic protrusion (61), wherein a first wall opening (63) is formed on the first wall (51) along another boundary of the first elastic protrusion (61).

12. The case (10) of claim 11, further comprising a second card retaining means (70) formed on the second wall (52) for retaining the one or more cards (90) in the card storage compartment (40) by exerting pressure on the one or more cards (90).

13. The case (10) of claim 12, wherein the second card retaining means (70) is made of elastic material, wherein the second card retaining means (70) comprises a second elastic protrusion (71) protruded from the second wall (52) towards the direction of the one or more cards (90) in the card storage compartment (40), wherein the second elastic protrusion (71) is sloped from the second wall (52) towards the third wall (53) in the direction of the one or more cards (90) in the card storage compartment (40), and wherein a second bottom opening (72) is formed on the bottom surface (41) along a boundary of the second elastic protrusion (71), wherein a second wall opening (73) is formed on the second wall (52) along another boundary of the second elastic protrusion (71).

14. The case (10) of claim 12, further comprising a third card retaining means (80) formed on the bottom surface (41) for retaining the one or more cards (90) in the card storage compartment (40) by exerting pressure on the one or more cards (90), wherein the third card retaining means (80) comprises a semi-elliptical protrusion (81) made of elastic material and protruded from the bottom surface (41) towards the direction of the one or more cards (90) in the card storage compartment (40), wherein a pair of openings (82), (83) are formed on the bottom surface (41) along both sides of the semi-elliptical protrusion (81), wherein a first cutout (31) is formed on the hard protective cover (30) for inserting or removing the one or more cards (90) to or from the card storage compartment (40), wherein a second cutout (32) is formed on the hard protective cover (30) for pushing the one or more cards (90) in the card storage compartment (40) for easy removal of the one or more cards (90) from the card storage compartment (40).

15. The case (10) of claim 11, wherein the card storage compartment (40) is made of thermoplastic polyurethane and the cover (30) is made of polycarbonate.

16. The case (10) of claim 9, wherein a first wall opening (63) is formed on the first wall (51) along a boundary of the first elastic protrusion (61).

17. The case (10) of claim 16, wherein a first bottom opening (62) is formed on the bottom surface (41) along a boundary of the first elastic protrusion (61).

18. The case (10) of claim 5, wherein a first wall opening (63) is formed on the first wall (51) along a boundary of the first elastic protrusion (61), and a first bottom opening (62) is formed on the bottom surface (41) along a boundary of the first elastic protrusion (61).

19. The case (10) of claim 4, wherein the card storage compartment (40) is made of thermoplastic polyurethane and the cover (30) is made of polycarbonate.

20. The case (10) of claim 1, wherein the card storage compartment (40) is made of thermoplastic polyurethane and the cover (30) is made of polycarbonate.

* * * * *